United States Patent [19]

Babson et al.

[11] Patent Number: 5,020,460

[45] Date of Patent: Jun. 4, 1991

[54] METHOD AND APPARATUS FOR ALIGNING A FABRIC PLY IN A SEWING MACHINE

[75] Inventors: Edward S. Babson, Ipswich; Thomas G. Brophy, Gloucester; Michael R. Porter, Topsfield, all of Mass.

[73] Assignee: Porter Sewing Machines, Inc., Beverly, Mass.

[21] Appl. No.: 345,404

[22] Filed: May 1, 1989

Related U.S. Application Data

[63] Continuation-in-part of Ser. No. 52,577, May 20, 1987, Pat. No. 4,825,787.

[51] Int. Cl.[5] ..... D05B 35/10; D05B 21/00

[52] U.S. Cl. ..... 112/262.3; 112/153; 112/306; 226/17

[58] Field of Search ..... 112/306, 308, 309, 153, 112/121.11, 136, 318, 262.3, 262.1, 320; 226/17, 15, 45

[56] References Cited

U.S. PATENT DOCUMENTS

| | | | |
|---|---|---|---|
| 3,013,513 | 12/1961 | Judelson | 112/306 |
| 4,159,687 | 7/1979 | Masuda et al. | 112/262.3 |
| 4,653,414 | 3/1987 | Harrington | 112/306 X |
| 4,660,481 | 4/1987 | Spickermann | 112/235 |
| 4,757,773 | 7/1988 | Nomura et al. | 112/153 X |
| 4,825,787 | 5/1989 | Babson et al. | 112/153 X |

FOREIGN PATENT DOCUMENTS

| | | | |
|---|---|---|---|
| 1464180 | 2/1977 | United Kingdom | 112/153 |

*Primary Examiner*—Peter Nerbun

*Attorney, Agent, or Firm*—Wolf, Greenfield & Sacks

[57] ABSTRACT

A method and apparatus are provided for aligning one or more plies of material moving in a predetermined direction, and preferably through a desired path of travel, prior to stitching in a sewing machine. A friction wheel or other guide element is provided for applying a force to the ply having a component in a direction transverse to the direction of travel and sensors are provided for sensing the transverse position of the ply at the point where the sensor is located relative to the desired transverse position at that point. The sensor outputs are weighted, and where two or more sensors are provided, the sensor outputs are combined in a predetermined manner. The combined and weighted outputs are then utilized to control the transverse force applied by the guide element to the ply. The operating speed of the sewing machine may be utilized either as an additional input to control transverse force or to control the rate at which adjustments are made to the transverse force.

39 Claims, 5 Drawing Sheets

METHOD AND APPARATUS FOR ALIGNING A FABRIC PLY IN A SEWING MACHINE

RELATED APPLICATIONS

This application is a continuation-in part of application Ser. No. 07/052,577, filed May 20, 1987, which will issue as U.S. Pat. No. 4,825,787 on May 2, 1989 and is entitled "Method And Apparatus For Guiding Fabric To A Sewing Machine".

FIELD OF THE INVENTION

This invention relates to improved methods and apparatus for automatically aligning fabric prior to stitching in a sewing machine.

BACKGROUND OF THE INVENTION

The parent application identified above describes a method and apparatus for performing twin overedging and seaming in one high speed operation, and in particular to an improved method and apparatus for automatically aligning the fabric plies prior to such a sewing operation. The apparatus of this application senses the transverse position of corresponding lateral edges of each of the two plies at a point in the path of travel just prior to reaching the sewing head and provides a friction wheel at a point in the path of travel of each ply prior to the sensing point. The angular position of each of the friction wheels is independently controlled to maintain the desired alignment of the fabric plies.

While the apparatus of the parent application operates satisfactorily in most applications, the apparatus does have certain limitations. First, there are two types of alignment errors which may occur for a given ply of material. The first is an offset error where the lateral edge of the ply remains parallel to the desired path of travel but is displaced a fixed distance from the desired path. The second type of error is an angular error where the lateral edge of the ply is at an angle to the path of travel. The single sensor located between the friction wheel and the sewing head can detect and generate corrections for either of these types of error. However, it is possible that if both an offset and an angular error exist, they will substantially compensate each other at the sensing point, resulting in an undetected and uncorrected alignment error at the sewing head.

Similarly, where large alignment errors exist, or where the fabric to be sewn has a curved lateral edge, as for example would be the case where a back pocket is being sewn on a pair of jeans, the single sensor between the sewing head and the friction wheel cannot detect changes soon enough or react quickly enough to variations to maintain the desired alignment, particularly when the sewing machine is being operated at a high speed, for example, 4000 to 5000 rpm.

Another potential problem with the existing apparatus when it attempts to stitch a curved seam or to overedge a curved edge is that the sensor in the path of travel prior to the sewing head, which sensor is aligned with the sewing head, will detect an error because the curved fabric is not aligned with the sewing head at the point in the path of travel where the sensor is located. The system, in attempting to compensate for this falsely perceived error, causes an alignment error by forcing the fabric into alignment at the sensing point, and thus out of alignment at the sewing head. Thus, the current apparatus is not adapted for use with a fabric ply having a curved lateral edge, either convex or concave, which is to be overedged or where curved seams are to be sewn.

Another potential problem with the apparatus of the parent application is that, when the sewing machine is operating at high speed, centrifugal force might cause the friction wheel to bounce or lift from the fabric, preventing the friction wheel from reliably performing the alignment function. To prevent this effect, a means must be provided for maintaining the pressure on the fabric by the friction wheel regardless of the machine operating speed. High speed operation also reduces the time available for making alignment corrections and may therefore require faster responses by the guide wheel to detected errors and/or larger angular corrections by the guide wheel for a given alignment error. The existing application does not have a mechanism for taking into account the operating speed of the sewing machine in making angularity corrections.

It is also desirable that the pressure applied by the friction wheel to the fabric ply be adjustable, either manually or automatically, to compensate for differences in fabric thickness, to possibly stretch one of the fabric plies where the plies are of uneven length, and for other purposes. It is also desirable that the sensing element be maintained steady regardless of any possible movement or bounce by the friction wheel during operation. This requires that a means be provided for independently mounting the friction wheel and sensors.

SUMMARY OF THE INVENTION

An object of this invention is therefore to provide an improved method and apparatus for aligning one or more plies of material in a sewing machine which permit corrections to be made, and desired alignments to be maintained, where large alignment errors exist, where compensating errors occur, where the sewing machine is operating at high speed, and where curved edges are to be overedged and/or curved seams to be sewn.

Another object of this invention is to provide apparatus for maintaining a desired pressure on the fabric by the friction wheel regardless of physical forces on the wheel resulting from the operating speed of the sewing machine and other factors.

Still another object of this invention is to provide an apparatus of the type indicated above which permits the pressure applied by the friction wheel to the fabric ply to be accurately controlled and which sufficiently separates the mountings of the friction wheel and sensors so that the sensors may remain steady regardless of movements caused to the friction wheel.

These and other objects are achieved in his invention by providing a method and apparatus for aligning a ply of material moving in a prescribed direction, and preferably through a desired path of travel, prior to stitching at a sewing head in a sewing machine. Guide means, such as a friction wheel, are provided for applying a force to the ply which force has a component in a direction transverse to the prescribed direction of travel. One or more sensors are provided, each located at a point at a distance $D_n$ in the fabric travel path ahead of the sewing head. The sensors sense the tranverse position of the ply at the point where the sensor is located relative to the desired transverse position at that point in the travel path. The output from each of the sensors is weighted and where there are two or more sensors, the weighted outputs are combined in a predetermined manner. The guide means is controlled in response to the combined weighted sensor outputs so as to apply a required transverse force component to the ply to maintain the ply within the desired travel path at the sewing head. There are preferably two or more sensors and the sensors are preferably located on opposite sides of the guide means. The weighting is preferably performed by weighting the sensor outputs inversely to the distance $D_n$ of the sensor from the sewing head and the error outputs from the sensors may be weighted either linearly or in accordance with a predetermined arithmetic progression. The weighted sensor outputs are summed or otherwise combined in a predetermined way and the resulting sum is divided by the number of sensors. The operating speed of the sewing machine may also be detected, and this value utilized either to control the transverse force component, to control the rate at which adjustments are made to the transverse force component or both. The transverse position of one or more of the sensors may be adjustable to eliminate curvature errors. The guide means or friction wheel may also be prebiased to a particular position, particularly when a ply having a curved edge is being sewn.

The guide means for applying a transverse force to the ply may include an arm adjacent the ply extending in a direction transverse to the travel path and beyond a lateral edge of the ply. The arm may be pivotably mounted at a point along the arm close to the extended end of the arm and a friction wheel having an adjustable angular position may be mounted near the nonextending end of the arm and adjacent the ply. Means may be provided for normally biasing the arm to a position where the friction wheel is out of contact with the ply and means may be provided for applying a selected force to the extended end of the arm in a direction to press the friction wheel against the ply with a predetermined pressure. Means may also be provided for maintaining the predetermined pressure applied to the ply constant regardless of changes in operating condition of the sewing machine. The force applying means is preferably a pneumatic cylinder which presses a piston-mounted pin against the arm. The pneumatic pressure in the cylinder, and thus the force applied to the arm, may be controlled either manually or automatically to control the pressure applied by the friction wheel to the ply and this pressure may be varied to compensate for variations in ply thickness and other factors. The sensor may be mounted to be moved with the arm but to be minimally influenced by bounce or other movement of the friction wheel and arm.

The foregoing and other objects, features and advantages of the invention will be apparent from the following more particular description of preferred embodiments of the invention as illustrated in the accompanying drawings.

DETAILED DESCRIPTION OF THE INVENTION

Figure 1:
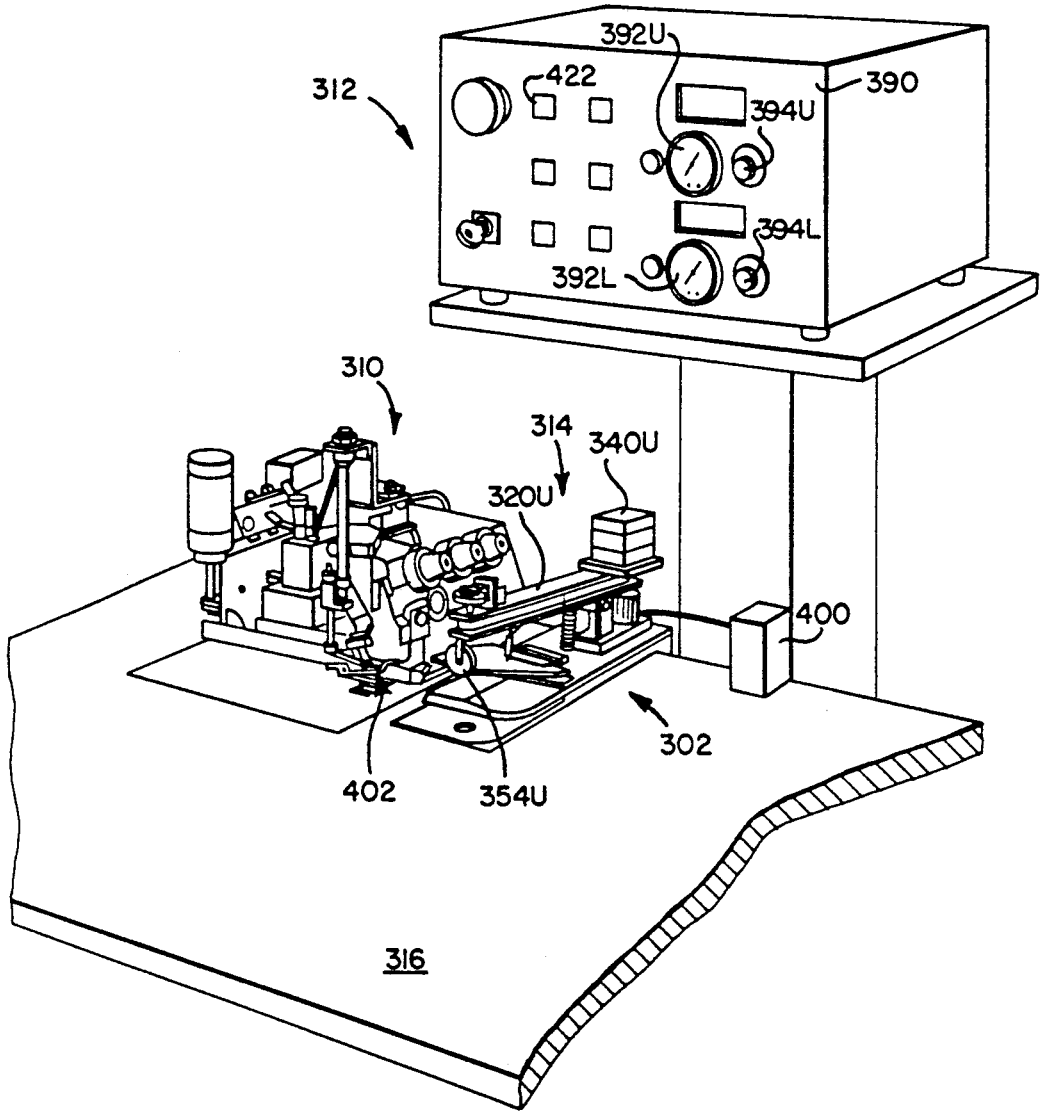
FIG. 1 is a perspective view of a sewing machine incorporating the teachings of this invention.

FIG. 1 shows a sewing machine 310 having a control device 312 and an alignment apparatus 314 in accordance with the teachings of this invention. The sewing machine 310 can be adapted for performing twin overedging and seaming in one high speed operation as described in the parent application and in U.S. Pat. No. 4,546,716, which application and patent are hereby incorporated by reference. As will be described later, the sewing machine may also be utilized to overedge a single ply of material, such as a pocket, having a curved lateral edge and to, for example, sew this pocket to a pants leg, shirt front or the like. The sewing machine 310 may also be used for other related applications In FIG. 1, the alignment apparatus 314 is shown in its open position in preparation for having one or more plies of material which are fed across table or platform 316 loaded therein.

Figures 2, 4:
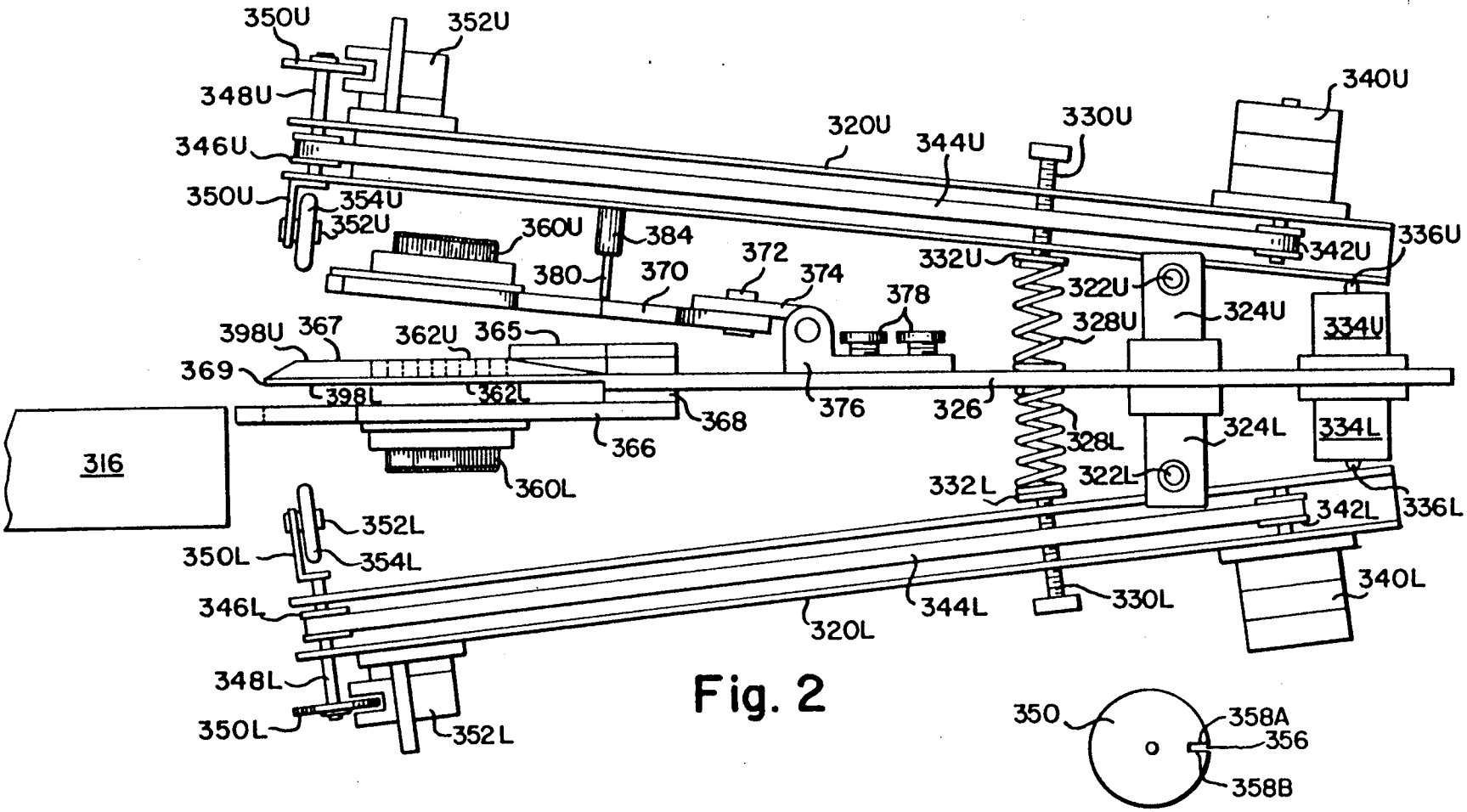
FIG. 2 is a rear elevation view of the alignment and sensing elements in accordance with a preferred embodiment of the invention, showing the elements in an open position in preparation for having fabric loaded therein.
FIG. 4 is a top view of the homing disc shown in FIGS. 2 and 3.

FIG. 2 is an enlarged view of the alignment apparatus 314 of FIG. 1 looking in from the rear of the apparatus, generally in the direction of arrow 302 of FIG. 1. Because of the table 316, only the top portion of the apparatus 314 shown in FIG. 2 is visible in FIG. 1.

Referring to FIG. 2, it is seen that the alignment apparatus includes an upper arm 320U and a lower arm 320L. Each arm 320 is formed of two strips which are attached at at least one end, this structure providing substantially enhanced rigidity; and is pivotably mounted by a pivot pin 322 on a post 324 which is attached to a fixed center plate 326 extending from sewing machine 310. Arms 320 are normally biased in the open position shown in FIG. 2 by compression springs 328 mounted between the respective arm and plate 326. The open position to which arms 320 are biased may be controlled by manually operated screws 330 screwed into corresponding holes formed in the top of discs 332 attached to the top of each spring 328. Each of the arms 320 may be transferred to its closed position shown in FIG. 3 by applying air pressure to a corresponding pneumatic cylinder 334 mounted on plate 326 causing a piston mounted pin 336 extending from the arm side of cylinder 334 to be extended to apply a predetermined force to the arm.

A stepping motor 340 is mounted on the outside of each of the arms 320. Motor 340 drives a pulley 342 which has a belt 344 mounted thereon. At its far end each belt 344 passes over a pulley 346 mounted on a shaft 348 which passes through the arm 320. The outside end of shaft 348 has a homing disc 350 mounted thereon, an edge detection mechanism 352 being mounted to the arm to read position from the homing disc. On its inside, each shaft 348 has a hub assembly 350 with an axle 352 extending therefrom generally parallel to the arm 320 and a friction wheel 354 mounted to rotate on axle 352.

Figure 3:
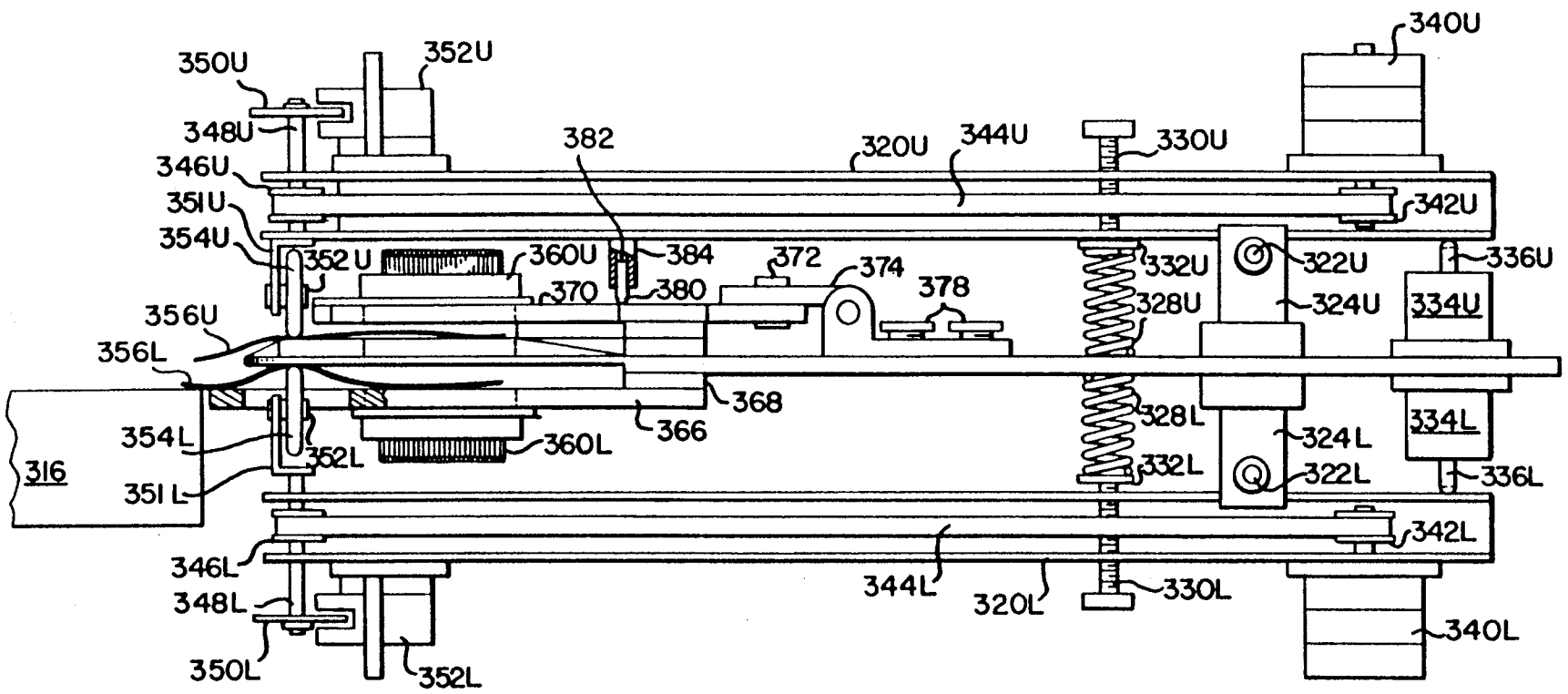
FIG. 3 is a rear elevation view of the elements shown in FIG. 2 with the elements in a closed position, having fabric loaded therein.

As may be best seen in FIG. 3, when cylinder 334 is energized to apply a force to arm 320 to move the arm to its active position, friction wheel 354 is pressed into contact with a fabric ply 356 passing through the machine, the fabric moving generally in the direction of the arrow 302 shown in FIG. 1. The pressure applied to the fabric by a friction wheel 354 is determined by a number of factors, including primarily the force applied to arm 320 by pin 336 as a result of pneumatic pressure in cylinder 334. Various ways of controlling this pressure will be discussed shortly.

As is discussed in the parent application, the alignment of fabric 356 may be controlled by controlling the angular position of friction wheel 354. This is accomplished by operating stepping motor 340 in a manner to be discussed in greater detail hereinafter. Homing disc 350 (FIG. 4) has a homing slot 356 formed therein which slot has two edges 358A and 358B. Homing disc 350 is considered to be in a home position when detector 352 detects that it is adjacent to a particular one of the edges 358, the manner in which this operation is performed also being described hereinafter. When homing disc 350 is in its home position, friction wheel 354 should be aligned with the prescribed direction 302 of travel for fabric 356.

A light source 360 is provided for each ply 356 and a linear array of photosensors 362 is provided for each light source. Light sources 360 preferably operate in the infrared portion of the spectrum in order to eliminate problems caused by ambient light in the visible portion of the spectrum. Linear array 362L is fixedly mounted in an extended portion 364 of plate 326. Linear photosensor array 362U is mounted on a moveable plate 367 held in place by recessed screw 365. For reasons which will be discussed later, when screw 365 is loosened, plate 367 may be moved in either the lateral or transverse direction to reposition linear array 362U. Lower light source 360L is mounted on an arm 366 which arm is attached to a spacer 368 which is in turn connected to plate 326. Arm 366 is substantially parallel to extended plate portion 364 and is spaced therefrom by a predetermined distance sufficient to permit fabric ply 356L to pass therebetween.

Upper light source 360U is mounted to an arm 370 which is attached by a bolt 372 or other suitable means to a bias spring 374 extending from a pivot support 376 which is attached to plate 326 by thumb screws 378. Spring 374 normally biases arm 370 to the position shown in FIG. 2 away from plate 367 so as to permit upper ply 356U to be easily fit between these two members. Screws 378 may be loosened to permit support 376, and thus light source 360U to be moved in conjunction with photosensor array 362U in either the lateral or transverse direction.

A pin 380 is biased against arm 370 by a spring 382 (FIG. 3) in a cylinder 384 which cylinder is attached to arm 320U. When pneumatic pressure is applied to cylinder 334 to move arm 320U to the position shown in FIG. 3, pin 380 is pressed against arm 370 to also lower this arm to the position shown in FIG. 3 where it is spaced from plate 367 by a distance slightly exceeding the thickness of fabric ply 356U. However, since pin 380 is loaded by spring 382, pin 380 will continue to bear against arm 370 to hold this arm in the desired position shown in FIG. 3 regardless of any bounce or other slight movement of friction wheel 354U and arm 320U.

Referring against to FIG. 1, the control assembly 312 has a control panel 390 and control electronics mounted therein. Control panel 390 includes gauges 392U and 392L for indicating the pressure applied by friction wheel 354U and 354L respectively to the respective fabric plies 356. The pressure applied by each of the friction wheels to its corresponding ply may be adjusted by operating the corresponding manually controlled dials 394 until the desired pressure reading appears on the corresponding gauge 392. The desired pressure may be varied depending on a number of factors including the type or thickness of the fabric 356 and may be set to a predetermined value for each type of fabric. Pressure may also be automatically controlled, either in addition to or instead of dials 394, in response to inputted or detected fabric thickness or other factors. To the extent the length of two fabric plies may not be the same, a predetermined additional pressure may be applied to the friction wheel for the shorter ply to stretch this fabric ply slightly as it is passed under the friction wheel so as to make the length of the plies uniform.

A pressure transducer 396 may be provided in plates 364 and 367 as shown in FIG. 2 which transducer indicate the pressure being applied by the corresponding wheel 354 to the adjacent fabric ply 356. The output from the transducer may be utilized to control the readings on the corresponding gauges 392, and may also be applied to a standard pressure regulator 400 (FIG. 1) to control the pneumatic pressure applied to the corresponding cylinder 334. This permits the pressure applied by the friction wheels to the fabric ply to be maintained constant regardless of the operating conditions of the sewing machine 310 and in particular regardless of the operating speed of the machine and the increased centrifugal forces applied to the friction wheel as a result of high speed machine operation. This serves to minimize lifting or bounce of the friction wheel when operating at high speeds and serves to maintain the fabric aligning capability of the friction wheel when operating at these speeds.

In the discussion to this point, it has been assumed that there is only a single sensor consisting of a light source 360 and photosensor array 362 for each ply, and that this sensor is located, as described in greater detail in the parent application, between friction wheel 354 and sewing head 402 of sewing machine 310. However, as has been previously discussed, such an arrangement has a number of limitations including:

(a) it may not be able to compensate for relatively large errors, particularly when the sewing machine is operating at high speeds;

(b) it cannot pick up an error when there is both an offset error and an angular error which compensate at the sensor; and (c) it is not adapted for handling a fabric ply having a curved lateral edge, and may in fact cause curvature errors for such curved fabric plies.

Figure 5:
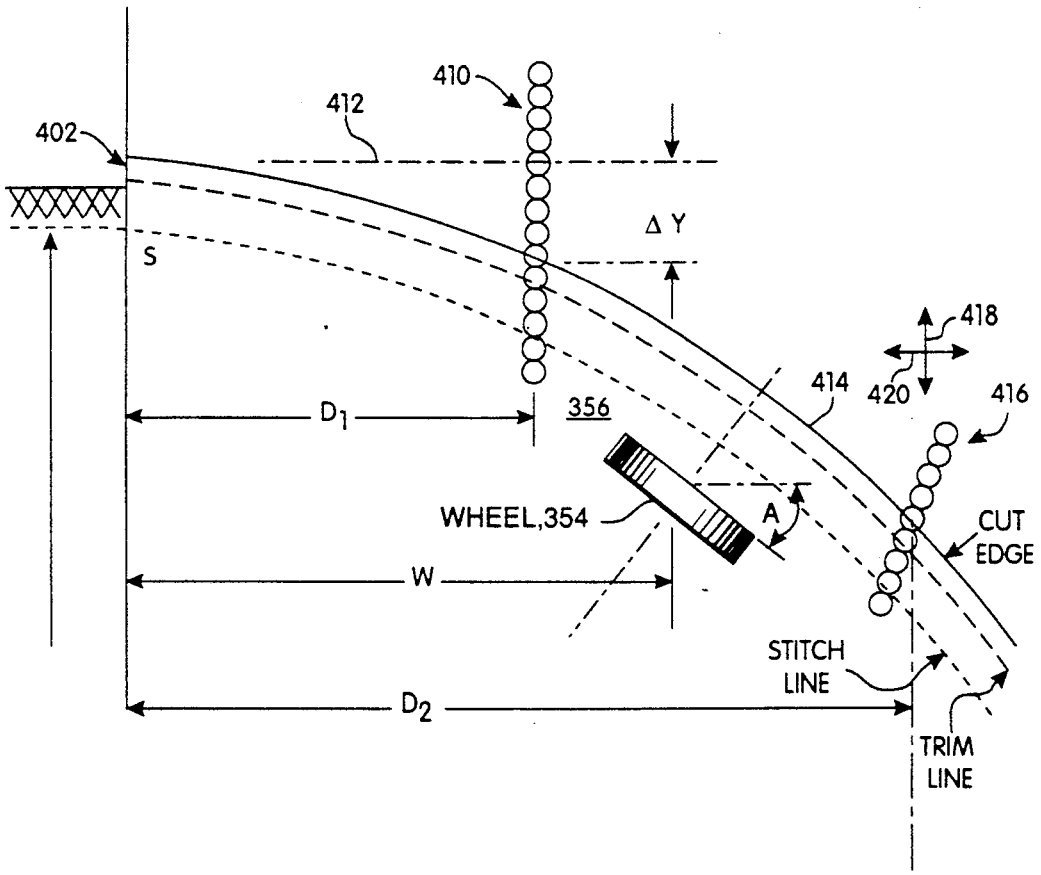
FIG. 5 is a top view in schematic form of various alignment and sensing elements of this invention illustrating the operation of the invention.

The reason for curvature errors with fabric having a curved edge may be illustrated from FIG. 5 with the linear photosensor array 410. For fabric having a straight lateral edge, the desired path of travel for such edge would be along the line 412 and sensor array 410 is positioned so that this line passes through the middle of the array. As indicated in the parent application, the system operates to move the material by use of friction wheel 354 so as to move the fabric edge 414 to the line 412 at the point in the travel path where array 410 is located. However, if such a correction were made with a piece of fabric having a curved lateral edge 414 as shown in FIG. 5, this would result in the fabric being above the desired transverse position at the sewing head 402 (i.e., position S) by a distance roughly equal to $\Delta Y$.

In accordance with the teachings of this invention, this curvature error can be eliminated by loosening screws 365 and 378 and moving sensor array 410 and the corresponding light source in a transverse direction by a distance roughly equal to ΔY, so that the sensor is generally positioned as shown by the dotted lines. This causes the curved fabric edge 414 to pass through the center of array 410 when the fabric edge is in the desired position at the point in the path of travel where the sensor is located. The sensors would be moved in the opposite direction where a ply having a concave rather than a convex curved edge was being sewn.

However, a single sensor may still not be able to cause sufficient movement of the fabric in order to permit the curved edge 414 to be followed. In accordance with the teachings of this invention, this problem is overcome by providing a second array of sensors 416 preferably located at a point on the opposite side of friction wheel 354 from the array 410. The position of the sensor array 416 is preferably adjustable both transversely as shown by arrow 418 and linearly as shown by arrow 420. The transverse adjustment 418 permits array 416 to be positioned with the center of the array at the transverse position where edge 414 should be located at the point in the travel path of the fabric 356 where the sensor is located. The ability to adjust the lateral position 420 of sensor array 416 permits the sensor array to be located at an optimum position for the particular curved fabric being provided. Thus, if fabric having a more sharply curved edge 414 is being used, it may be desirable for the distance D2 between the sewing head 402 and the point in the travel path where the sensor array 416 is located to be greater than if the edge 414 has only a slight curve. For substantial curves, two or more sensor arrays 416 may be utilized on the side of friction wheel 354 opposite sewing head 402. In some applications, it may also be desirable to have two or more sensor arrays 410 located between the friction wheel and the sewing head.

In FIG. 5 the sensor array 416 has also been shown positioned at an angle to a line transverse to the travel path rather than normal to the travel path as for the bank 410. This angular alignment provides continuous sensing without gaps as may occur with a straight transverse alignment.

Even with the use of a single sensor 410, weighting of the sensor outputs may be desirable. Thus, the angle A at which the friction wheel 354 is turned from the home position or preferred direction of fabric movement 302 may be linear or constant, for example ±4 degrees per sensor element. Thus, if the edge 414 of the fabric 356 was positioned one sensor element to either side of the line 412 at sensor array 410, the wheel might be moved by an angle of ±4 degrees; for ± two sensors, ±8 degrees; for ± three sensors, ±12 degrees; for ± four sensors, ±16 degrees; and for ± five sensors, ±20 degrees. However, better results might be obtained by having the angles increase in accordance with an arithmetic progression, rather than linearly, as the error increases. An example of a suitable arithmetic progression might be the following:

| ERROR (Sensor Elements) | WHEEL ANGLE (Deqrees) |
|---|---|
| 0 | 0 |
| ±1 | ±4 |
| ±2 | ±8 |
| ±3 | ±12 |
| ±4 | ±18 |

-continued

Figure 6:
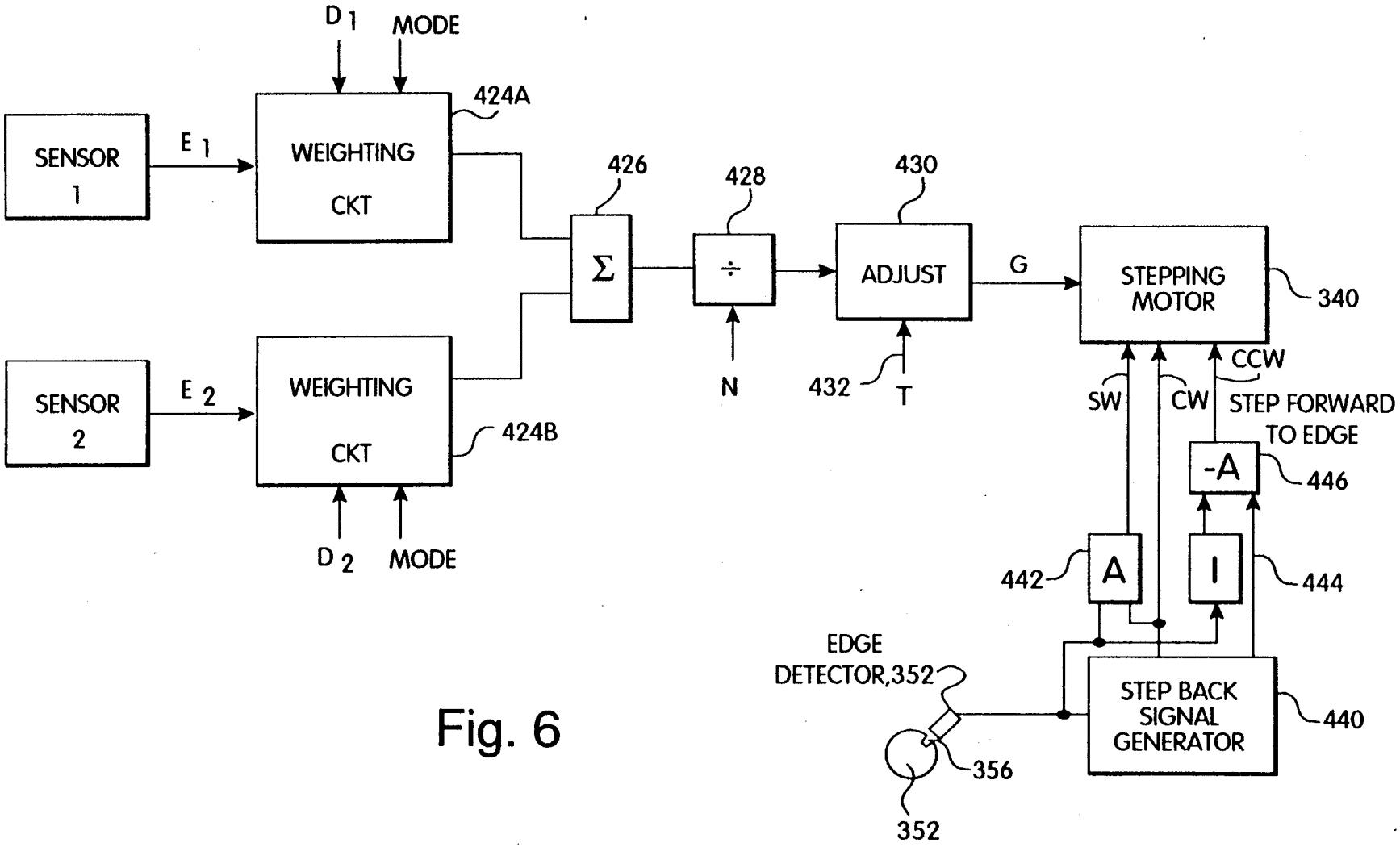
FIG. 6 is a schematic diagram of circuitry suitable for use in implementing the invention.

| ERROR (Sensor Elements) | WHEEL ANGLE (Deqrees) |
|---|---|
| ±5 | ±28 |

Where two or more sensors are employed, weighting becomes more critical. In this situation, weighting can be accomplished based on the distance $D_n$ of the sensor array from sewing head 402, the weight applied to a sensor output being inversely proportioned to the distance of the array from the sewing head. Thus, as illustrated in FIG. 6, the sensor outputs E1 and E2 from sensors 410 and 416, respectively, could each be applied to a weighting circuit 424. The other inputs to each weighting circuit are the distance of the array from sewing head 402 and a mode indication of whether the weighting is to be linear or arithmetic in accordance with some predetermined arithmetic progression. The mode input might for example be a binary 0 for linear weighting and binary 1 for weighting in accordance with an arithmetic progression. The mode could be selected by an operator operating an appropriate control, for example, button 422 on control panel 390.

The output from each of the weighting circuits 424 is a value which is indicative of the desired angular change resulting from the error input divided by the distance of the sensor from the sewing head. The value indicative of angle may be obtained from a table look up memory with the mode bit serving as the most significant bit of the address input to this memory and the number of sensor elements of deviation providing the remaining address bits.

The outputs from the weighting circuits are summed in an adding circuit 426 and are then divided by the number of sensors in a division circuit 428. For the embodiment shown in FIG. 2, the value N inputted to the circuit 428 would be 2. The resulting output may be applied to an adjust circuit 430 which receives an input 432 from a tachometer or other suitable device which is indicative of the operating speed of the sewing machine 310. To the extent the tachometer generates an analog output, the adjust circuit 430 may contain an A to D converter or an A to D converter may be provided between the tachometer output and the circuit 430. The effect of circuit 430 is to increase the angle A of the wheel 354 for a given detected error as the speed of operation of the sewing machine increases. The sign of the sensor error outputs would be carried through to assure that the angular correction is made in the right direction.

It should at this point be noted that instead of the tachometer output 432 being utilized as shown in FIG. 6 to control the angle A of the wheel 354, the output from the tachometer may instead be utilized to control the rate at which servomotor 340 makes angle adjustments. With this embodiment of the invention, the output G indicative of angular correction would be from divide circuit 428 to stepping motor 340 to control the angular displacement thereof, and there would be a separate output from adjust circuit 430 to the stepping motor to control the rate at which stepping occurs. Thus, for this embodiment:

$$G = \frac{\sum_{1}^{n} (E_n/D_n)}{N}$$

The angle of the wheel 354 determines the transverse force component of the force applied to the fabric ply by the friction wheel.

Also shown in FIG. 6 is circuitry for controlling the homing of wheel 354. As previously indicated, homing disc 350 has a home slot 356 with two edges 358A and 358B (FIG. 4). When a wheel 354 is to be moved to its home position, the stepping motor moves the wheel until an edge 358 is detected by edge detector 352. However, when this occurs, it is not known whether the detected edge is edge 358A or 358B. Assume for example that it is desired to home on edge 358A. Therefore, when an edge is first detected, a signal is applied to the stepper motor 340 by step-back signal generator 440 to cause a slight movement of the disc in the clockwise direction. If the initially detected edge is edge 358B, such movement in the clockwise direction will cause a second edge detection to occur. This fully enables AND gate 442, causing an output to be applied to the stepping motor to stop the motor at that location. When the back stepping operation has been completed, a signal is applied to line 444. If the second edge is not being detected at this time, it means that the originally detected edge was the desired edge 358A. Under these conditions, AND gate 446 is fully enabled to generate an output which causes the stepping motor to move the disc 350 in the counterclockwise direction until the original edge is again detected, at which point the operation stops. This assures that homing always occurs on the same edge.

Further, while the home position for a wheel 354 is normally aligned with the preferred fabric travel path direction 302, particularly where fabric having a curved lateral edge is utilized, it may be preferable to preload the wheel angle A to an angle which will cause the fabric to follow the desired curve. Sensed errors would cause movement from the present angle. This angle may be manually preset utilizing a suitable control on panel 390 or may be automatically determined from an input indicative of the curve for the fabric lateral edge. The determined input would be applied to control stepping motor 340 to move the wheel to the desired angle.

However, in either selecting angle presets or weightings, care must be exercised that the angle does not become too large, since this may cause the fabric 336 to wrinkle, slip, or both, resulting in the friction wheel 354 losing control. This may occur for angles A in excess of approximately 35 degrees.

While special purpose circuitry has been shown in FIG. 6 for performing the various functions indicated, it is to be understood that these functions could be performed by a general purpose computer, such as a microprocessor, programmed to performed the indicated functions. Further, while the cylinders 336 have been indicated as being pneumatically actuated, it is apparent that these cylinders could be hydraulically actuated, that sensors other than photodetectors might be utilized, that the weighting and/or combining of sensor outputs would be performed in manners other than those disclosed, and that other changes might be made in specific components and operations described. Thus, while the invention has been particularly shown and described above with respect to preferred embodiments, the foregoing and other changes in form and detail may be made therein by one skilled in the art without departing the spirit and scope of the invention.

What is claimed is:

1. Apparatus for aligning a ply of material moving in a prescribed direction and preferably through a desired path of travel prior to stitching at a sewing head in a sewing machine, said apparatus comprising:

guide means for applying a force to said ply having a component in a direction transverse to said prescribed direction;

two or more sensing means, each located at a point which is a distance $D_n$ in said travel path ahead of said sewing head for sensing the transverse position of said ply at the point relative to the desired transverse position at said point, in the travel path;

means for weighting the outputs from said sensing means;

means for combining said weighted outputs in a predetermined way; and means responsive to the combined, weighted sensing means outputs for generating a control signal to said guide means for said transverse force component to maintain said ply within the desired travel path at least at said sewing head.

2. Apparatus as claimed in claim 1 wherein said means for weighting weights said sensor outputs inversely to the distance $D_n$ of each sensor.

3. Apparatus as claimed in claim 2 wherein said means for combining operates in accordance with the formula:

$$G = \frac{\sum_{1}^{n} (E_n/D_n)}{N}$$

where

G is an indicator of transverse component;

$E_n$ is the error in transverse position sensed at sensing means n; and

N is the number of sensing means.

4. Apparatus as claimed in claim 3 wherein said means for weighting linearly weights the errors $E_n$ sensed by the sensing means.

5. Apparatus as claimed in claim 1 wherein each sensing means generates an error output indicative of the difference between the sensed transverse position of the ply and the desired transverse position; and wherein said weighting means weights said error outputs in accordance with a predetermined arithmetic progression.

6. Apparatus as claimed in claim 1 including means for indicating the rate at which said ply is moving through its travel path; and wherein said control generating means is also responsive to said rate indicating means.

7. Apparatus as claimed in claim 1 wherein said guide means is a friction wheel, the angular position of which determines said transverse force component.

8. Apparatus as claimed in claim 7 including means for indicating the rate at which said ply is moving through its travel path;

wherein said control generating means controls the angle of said wheel; and wherein the rate at which said control generating means controls the wheel angle is a function of the rate indicated by said rate indicating means.

9. Apparatus as claimed in claim 1 wherein there is a first sensing means located between said sewing head and said guide means and a second sensing means located along the travel path on the opposite side of said guide means.

10. Apparatus as claimed in claim 9 wherein said ply is aligned along a lateral edge; and including means for adjusting the transverse position of at least said second sensing means so that said second sensing means is centered at the desired transverse location of said edge at the lateral point in the travel path where said second sensing means is located.

11. Apparatus as claimed in claim 9 wherein said ply is aligned along a curved lateral edge thereof; and wherein said desired travel path tracks said curved lateral edge.

12. Apparatus as claimed in claim 1 including means for adjusting the lateral position of at least one of said sensing means.

13. Apparatus as claimed in claim 1 wherein, when said guide means is in a home condition, it normally applies no transverse force component to said ply; and wherein said control generating means includes means for causing said guide means to have a predetermined transverse force component in the home condition.

14. Apparatus as claimed in claim 13 wherein said guide means is a friction wheel, the angular position of which determines said transverse force component; and wherein said causing means causes said friction wheel to assume a predetermined angular position when in its home condition.

15. Apparatus as claimed in claim 1 wherein said sensing means includes a light source positioned on one side of said ply and a linear photosensor array mounted to received light from said source on the opposite side of said ply from said light source, said linear array being at a slight angle to the transverse of said path of travel.

16. Apparatus as claimed in claim 15 wherein said ply is aligned along a lateral edge thereof; and wherein said photosensor array is substantially centered at the desired transverse position of said lateral edge at the point in said path of travel where said sensing means is located.

17. Apparatus as claimed in claim 1 wherein said guide means is a friction wheel, the angular position of which determines said transverse force component;

wherein when said friction wheel is in a home position, it is angled in said prescribed direction; and including a homing disc mounted to rotate with changes in angular position of said wheel, a home position slot in said disc, means for sensing an edge of said slot, means operative when an edge of said slot is detected for backing up said disc slightly, means operative if another edge is detected when said disc is backed up for utilizing the position of the other edge as the home position, and means operative if another edge is not detected for returning to the detected edge and utilizing the returned to position as the home position.

18. Apparatus as claimed in claim 1 including means for adjusting the lateral position of at least one of said sensing means.

19. Apparatus as claimed in claim 1 wherein said apparatus is utilized to align an upper and a lower ply to be stitched together;

wherein the are separate guide means and separate sensing means for each of said plies; and wherein the transverse force components of said guide means are independently controlled.

20. In an apparatus for aligning a ply of material moving in a prescribed direction through a desired path of travel to be stitched at a sewing head in a sewing machine, a guide means for applying a transverse force to said ply comprising:

a substantially straight arm adjacent said ply extending in a direction transverse to said travel path and beyond a lateral edge of said ply;

means for pivotably mounting said arm at a point along the arm closer to the extending end of the arm than to the other end of the arm, but not at the extending end;

means for mounting a friction wheel having an adjustable angular position near the other end of said arm and adjacent said ply;

means for normally biasing said arm to a position where said friction wheel is out of contact with said ply; and means for applying a selected force to the extended end of said arm in a direction to press said friction wheel against said ply with a predetermined pressure.

21. Apparatus as claimed in claim 20 including means for maintaining said predetermined pressure applied to the ply constant regardless of changes in operating conditions of said sewing machine.

22. Apparatus as claimed in claim 20 wherein said force applying means is a pneumatic cylinder which presses a piston mounted pin against said arm.

23. Apparatus as claimed in claim 22 including means for controlling the force applied to the arm by said cylinder to control the amount of said predetermined pressure.

24. Apparatus as claimed in claim 23 wherein said means for controlling includes a manual pressure control, a pressure sensor and a visual pressure indicator.

25. Apparatus as claimed in claim 22 wherein said pressure is controlled to compensate for variations in ply thickness.

26. Apparatus as claimed in claim 22 wherein said pressure is controlled to control stretching of said ply.

27. Apparatus as claimed in claim 20 wherein said means for normally biasing is a compression spring mounted between the pivot point of said arm and the friction wheel.

28. Apparatus as claimed in claim 20 including means for sensing the transverse position of said ply at one or more selected positions along said path of travel; and means for mounting said sensing means so that the sensing means is minimally influenced by bounce or other movement of said friction wheel and said arm.

29. Apparatus as claimed in claim 28 including a stationary member adjacent said arm, said ply passing between said member and arm;

means for pivotably mounting at least a portion of said sensing means to said member;

means for normally biasing said pivotably mounted portion away from said member; and means responsive to said arm being moved to cause said friction wheel to apply pressure to said ply for applying a force to move said sensing means portion to an operative position adjacent said ply.

30. Apparatus as claimed in claim 29 wherein the means applying force to move the sensing means includes a spring loaded pin mounted to said arm, whereby movement of said arm does not result in a corresponding movement of said sensing means.

31. Apparatus as claimed in claim 20 wherein said apparatus is utilized to align an upper and a lower ply to be stitched together at said sewing head, and wherein there is a separate pivotably mounted arm, friction wheel, biasing means and force applying means for each of said plies.

32. A method for aligning a ply of material moving in a prescribed direction and preferably through a desired path of travel prior to stitching at a sewing head in a sewing machine, the method comprising the steps of:

sensing the transverse position of said ply at at least two points in said travel path;

weighting the results of the sensing step;

combining the results of the weighting step in a predetermined way; and utilizing the results of the combining step to control a transverse force component applied to said ply by a guide means, said transverse force component modifying the alignment of said ply.

33. A method as claimed in claim 32 wherein said means for weighting weights said outputs inversely to the distance $D_n$ of each output.

34. A method as claimed in claim 33 wherein said combining step is performed in accordance with the formula:

$$G = \frac{\sum_{1}^{n} (E_n/D_n)}{N}$$

where

G is an indicator of transverse component;

$E_n$ is the error in transverse position sensed at sensing means n; and

N is the number of sensing means.

35. A method as claimed in claim 32 wherein said weighting step weights sensed error from said sensing step in accordance with a predetermined arithmetic progression.

36. A method as claimed in claim 32 including the steps of determining the rate at which said ply is moving through its travel path; and utilizing the results of said determining step during said control step.

37. A method as claimed in claim 32 wherein said ply is aligned along a curved lateral edge thereof; and wherein said desired travel path tracks said curved lateral edge.

38. Apparatus for aligning a ply of material moving in a prescribed direction and preferably through a desired path of travel prior to stitching at a sewing head in a sewing machine, said apparatus comprising:

guide means for applying a force to said ply having a component in a direction transverse to said prescribed direction;

sensing means located at a point in said travel path ahead of said sewing head for sensing the transverse position of said ply at the point relative to the desired transverse position at said point;

means for weighting the output from said sensing means; and means responsive to the weighted sensing means output for generating a control signal to said guide means for said transverse force component to maintain said ply within the desired travel path at least at said sewing head.

39. Apparatus as claimed in claim 38 wherein each sensing means generates an error output indicative of the difference between the sensed transverse position of the ply and the desired transverse position; and wherein said weighting means weights said error outputs in accordance with a predetermined arithmetic progression.

* * * * *